United States Patent [19]

Saxe et al.

[11] 4,072,107

[45] Feb. 7, 1978

[54] MISSILE CONTROL MEANS

[75] Inventors: Frederick E. Saxe, Sparta; Seymour K. Einbinder, Wayne, both of N.J.

[73] Assignee: The United States of America as represented by the Secretary of the Army, Washington, D.C.

[21] Appl. No.: 645,101

[22] Filed: June 7, 1967

[51] Int. Cl.[2] ..... F42B 25/16; F42B 13/48

[52] U.S. Cl. ..... 102/4; 102/7.2; 102/68; 102/69; 244/3.27

[58] Field of Search ..... 244/3.27, 3.28, 138, 244/138 A; 102/4, 7.2, 68, 69

[56] References Cited

U.S. PATENT DOCUMENTS

| | | | |
|---|---|---|---|
| 3,013,490 | 12/1961 | Flatau | 102/7.2 |
| 3,063,375 | 11/1962 | Hawley et al. | 244/3.27 |
| 3,093,072 | 6/1963 | Pigman | 102/7.2 |
| 3,098,445 | 7/1963 | Jackson | 244/3.27 |
| 3,263,612 | 8/1966 | Throner, Jr. | 102/68 |
| 3,276,367 | 10/1966 | Edwards | 102/4 |
| 3,291,418 | 12/1966 | Brunk et al. | 244/138 A |

*Primary Examiner*—David H. Brown

*Attorney, Agent, or Firm*—Nathan Edelberg; A. Victor Erkkila; Thomas R. Webb

[57] ABSTRACT

The application discloses a sub-missile which breaks up into fragments less than one grain in size and thereby has a lethal effect on personnel. The sub-missiles can be utilized in large missiles and rockets as a warhead by means of a canister so designed that the sub-missiles are dispersed through centrifugal force. The canister is provided with a plurality of control fins for slowing and then rotating the canister in flight, a plurality of rotary tubes and pivoted arms supporting the fins for rotating and pivoting about two different axes, and two separate means for independently actuating the tubes and arms to move the fins to canted, extended positions.

6 Claims, 14 Drawing Figures

Figure 1:
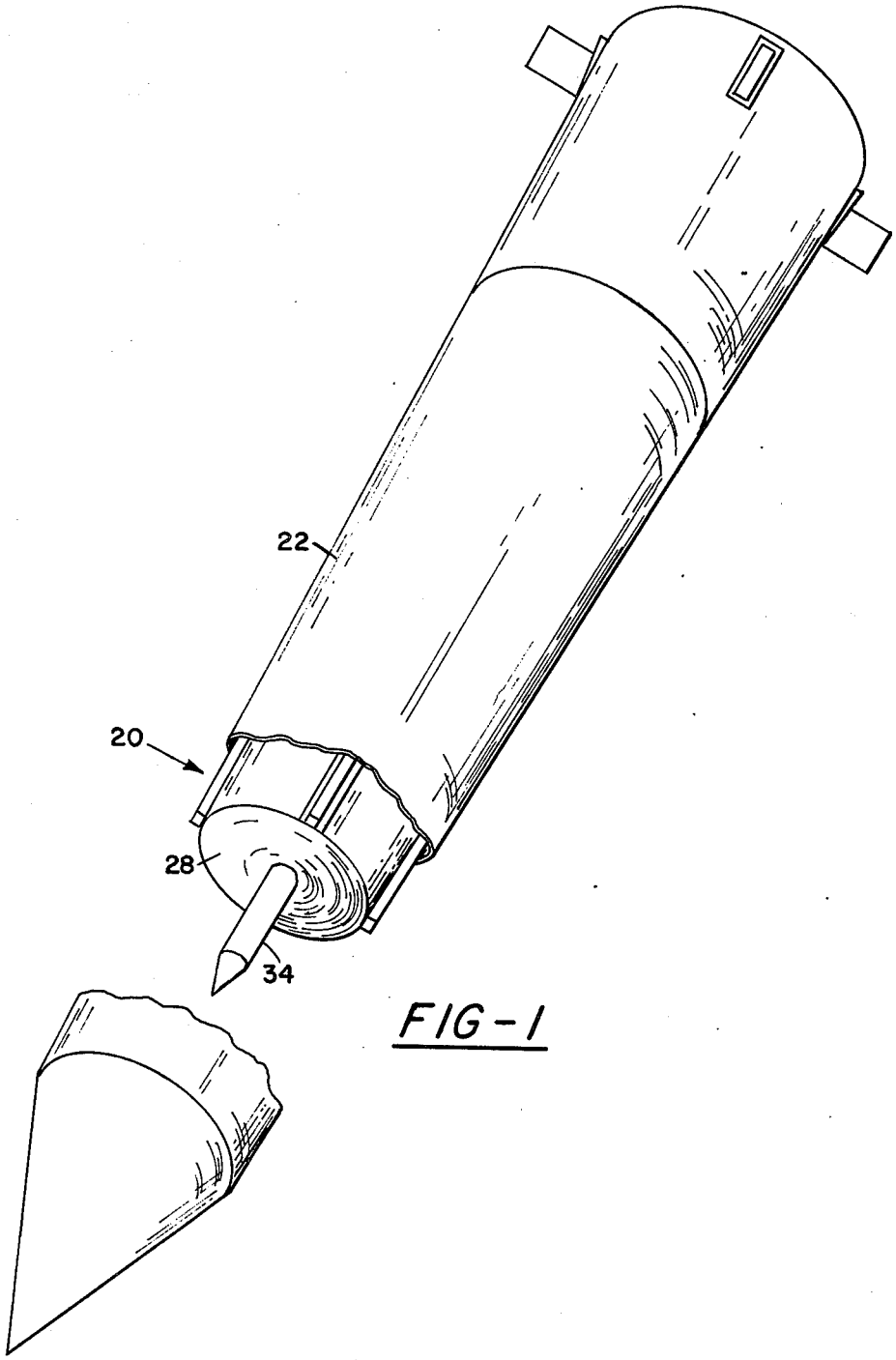

INVENTORS
Frederick E. Saxe
Seymour K. Einbinder
BY Harry M. Saragovitz
Edward J. Kelly
Herbert Berl
Lawrence S. Epstein INVENTOR.
Frederick E. Saxe
Seymour K. Einbinder
BY Harry M. Saragovitz
Edward J. Kelly
Herbert Berl
Lawrence S. Epstein INVENTORS:
Frederick E. Saxe
Seymour K. Einbinder
BY Harry M. Saragovitz
Edward J. Kelly
Herbert Berl
Lawrence S. Epstein INVENTORS:
Frederick E. Saxe
Seymour K. Einbinder
BY Harry M. Saragovitz
Edward J. Kelly
Herbert Berl
Lawrence S. Epstein INVENTORS
Frederick E. Saxe
Seymour K. Einbinder
BY Harry M. Saragovitz
Edward J. Kelly
Herbert Berl
Lawrence S. Epstein INVENTORS
Frederick E. Saxe
Seymour K. Einbinder
BY Harry M. Saragovitz
Edward J. Kelly
Herbert Berl
Lawrence S. Epstein INVENTORS:
Frederick E. Saxe
Seymour K. Einbinder
BY Harry M. Saragovitz
Edward J. Kelly
Herbert Berl
Lawrence S. Epstein INVENTORS
Frederick E. Saxe
Seymour K. Einbinder
BY Harry M. Saragovitz
Edward J. Kelly
Herbert Berl
Lawrence B. Epstein

MISSILE CONTROL MEANS

This invention relates to a warhead for a missile which is capable of effective anti-personnel and other target action, and is particularly adapted to pierce light armored vehicles and trucks, as well as to be very lethal against exposed personnel.

It is well known in explosive ordnance that the effectiveness of explosive munitions diminishes as a cube of the distance from the point of detonation. Thus, in standard bombs or missile wardheads, the explosive energy available is not utilized to the maximum extent possible.

Many methods had been attempted previously to obtain a uniform distribution of payload over a large area. For example, an early procedure consisted of clustering bombs in packages such as clusters of twenty-pound fragmentation bombs or the smaller 4-pound "butterfly" bombs. However, in addition to failure to provide uniform distribution, these clusters of bombs depended on random air-stream buffeting for dispersion of the bomblet. Thus, the maximum area covered on the ground was small. This limited the number of bomblets that could be carried in a given payload without having them tend to cluster about the main point of impact, whereby overkill in the center would take place. A more recent attempt to provide uniform distribution over large areas consisted in the use of spherical submunitions effective as rotary air foils. These were self-dispersing through a phenomenon known as "Magnus Lift". As a result, spherical munitions had to be used, causing half of the fragments to be ejected downward into the ground with a large percentage of the other half to be ejected up into the air. The use of bomblets with highly directional effects, such as shaped charges, was precluded.

These deficiencies of the prior art are overcome by the instant invention. The submissiles are oriented, so that fragments are expended only in useful directions. By this, the vast majority travel from the horizontal to a small angle above the horizontal, preventing waste engendered when ejected into the ground or into the air. Further, with the submunition stabilized, the addition of a metallic liner at the base of the explosive charge shapes the charge so that armor can be pierced. By the invention, the submissiles are slowed down so that the dynamic pressure from the air stream does no damage. Then they are ejected from within the nose cone to the air stream; and finally, they achieve a radial velocity whereby they are uniformly distributed over the area of attack. Thus, the need for a very large payload, with its attendant loss of effectiveness with distance from the point of burst, is avoided. The interchangeability of warheads is another advantage and protection from the high temperatures of re-entry is also provided.

It is therefore an object of the invention to provide a warhead that is effective against materiel such as trucks, lightly armored vehicles and against exposed personnel.

It is another object to provide an improved method of reducing large payloads with its loss of effectiveness at greater distances from the point of burst, into many smaller munitions which instead provide a relatively uniform effectiveness over a much larger area.

It is still another object to provide a submissile that will disperse uniformly over a very wide area whereby it may have a devastating effect against personnel.

It is yet another object to provide a container for the submissile that is very stable whereby release of the submissiles enables them to fall uniformly over the selected area.

It is yet another object to provide a shaped charge whereby release of the submissiles enables them to pierce any light armored vehicles in their path of fall.

It is still another feature that the effectiveness of the submunition is increased by the use of centrifugal force.

It is yet an important feature to provide a canister container of a high drag configuration, and with specially constructed fins, operation of which serves first to act as drag brakes to slow down the fall and second to rotate the canister so that the submissiles are dispersed by the resultant centrifugal force.

Figure 2:
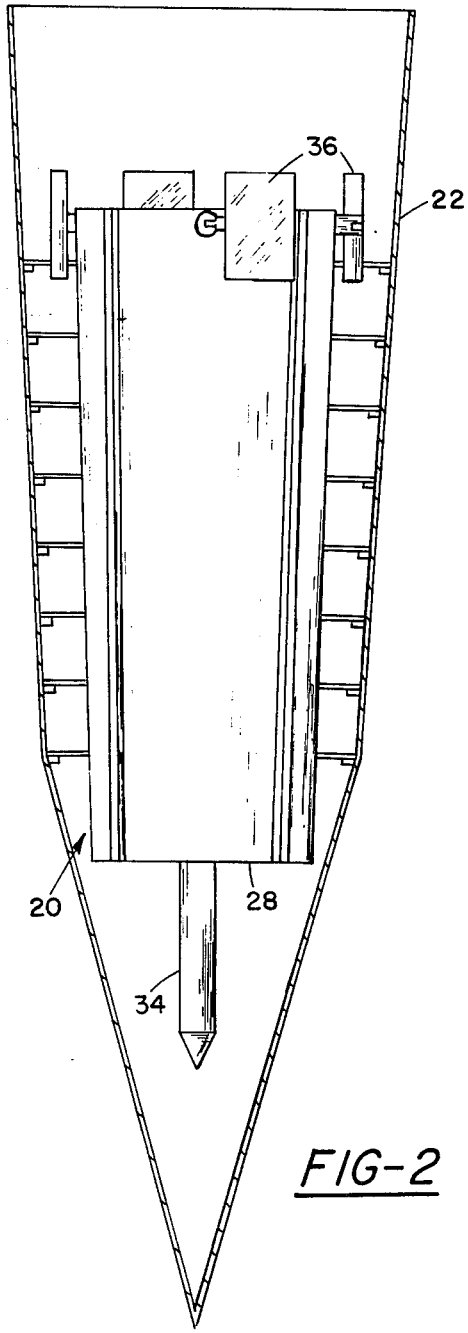
Figure 3:
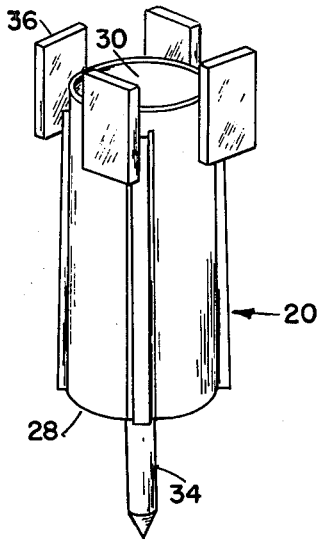
Figure 4:
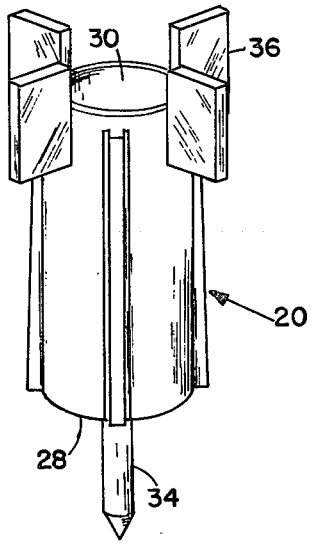
Figure 5:
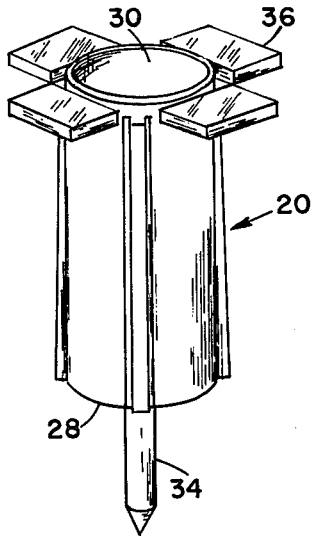
Figure 6:
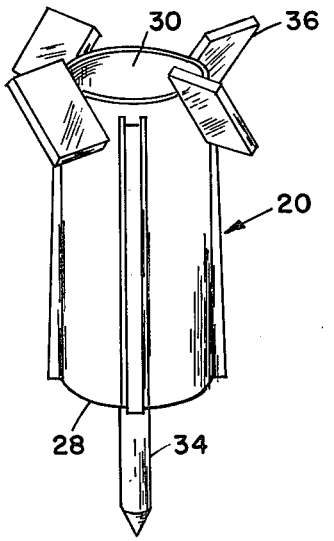
Figure 7:
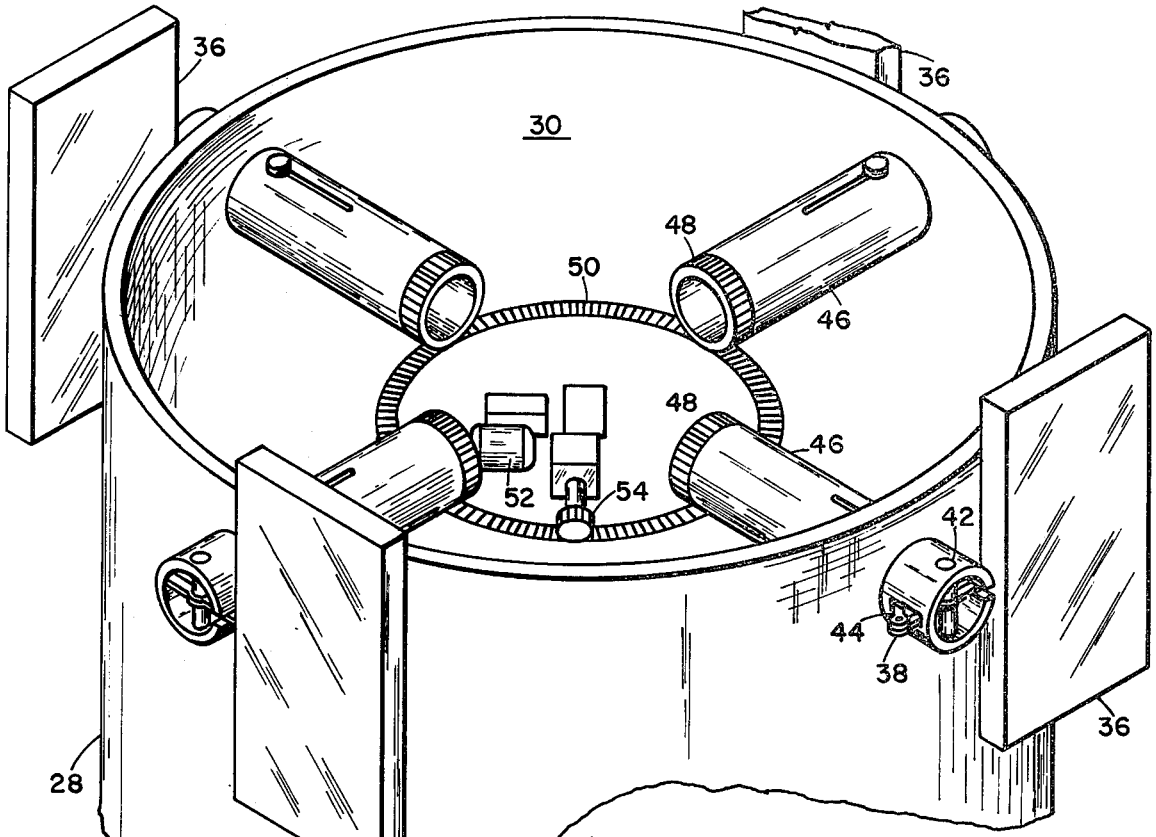
Figure 8:
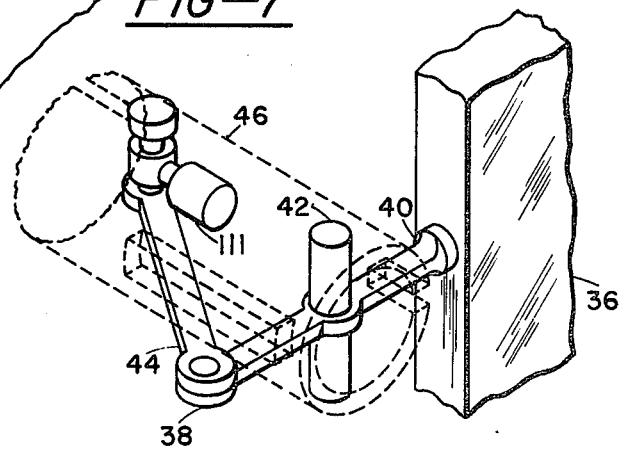
Figure 9:
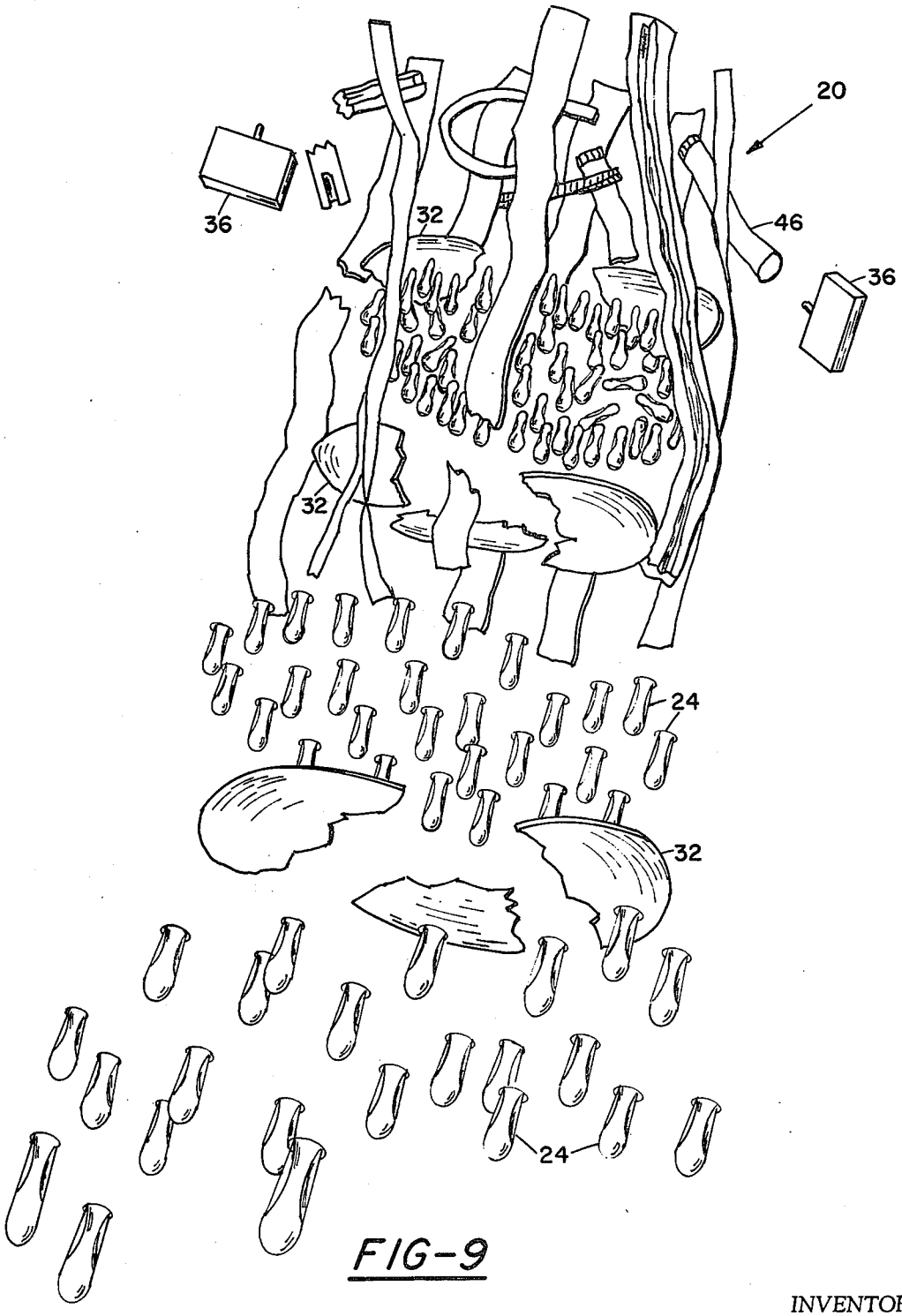
Figure 10:
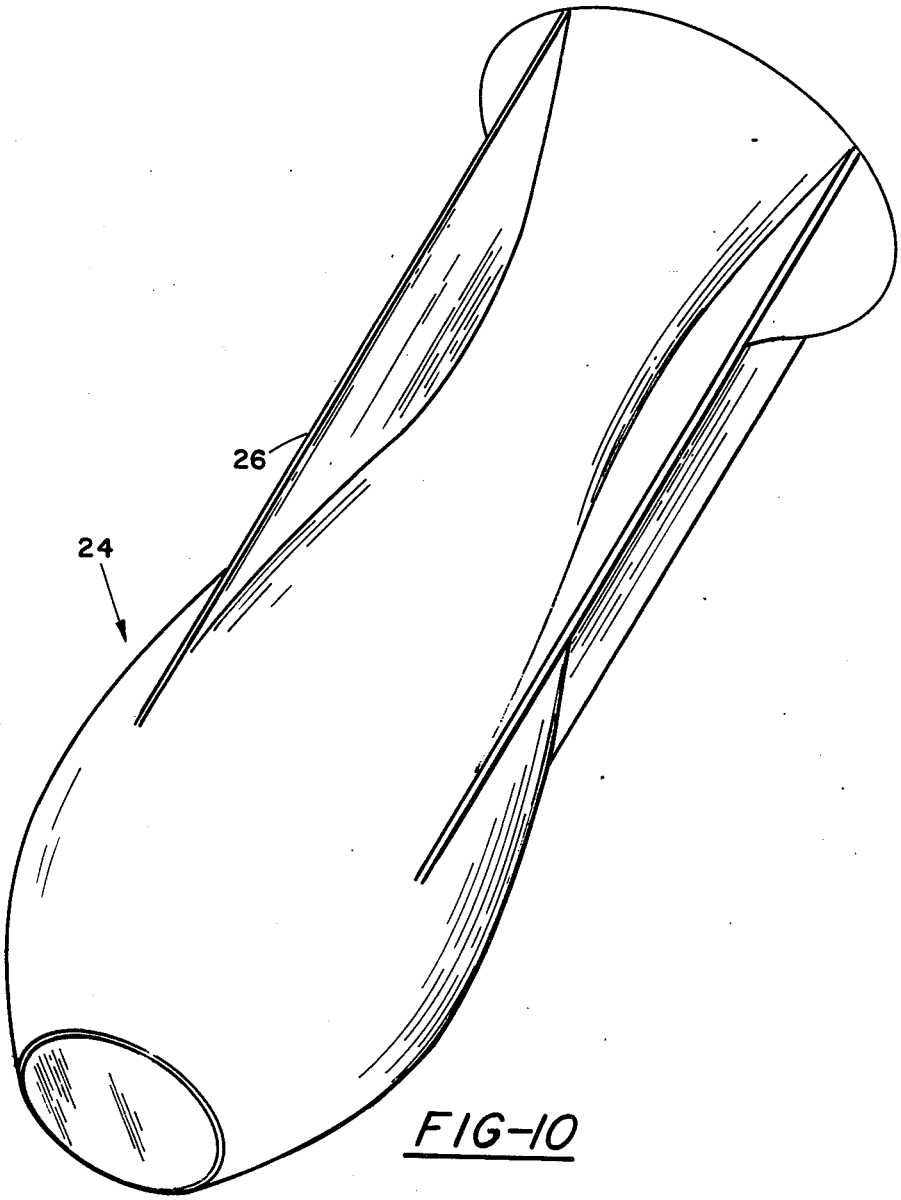
Figure 11:
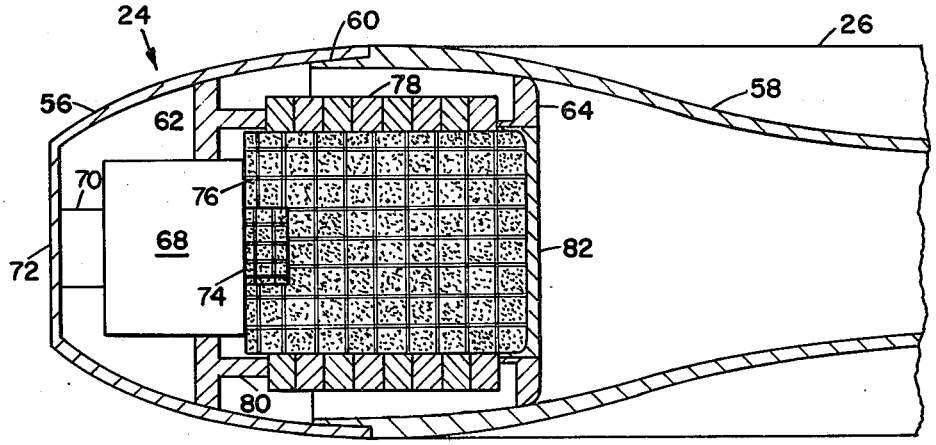
Figure 12:
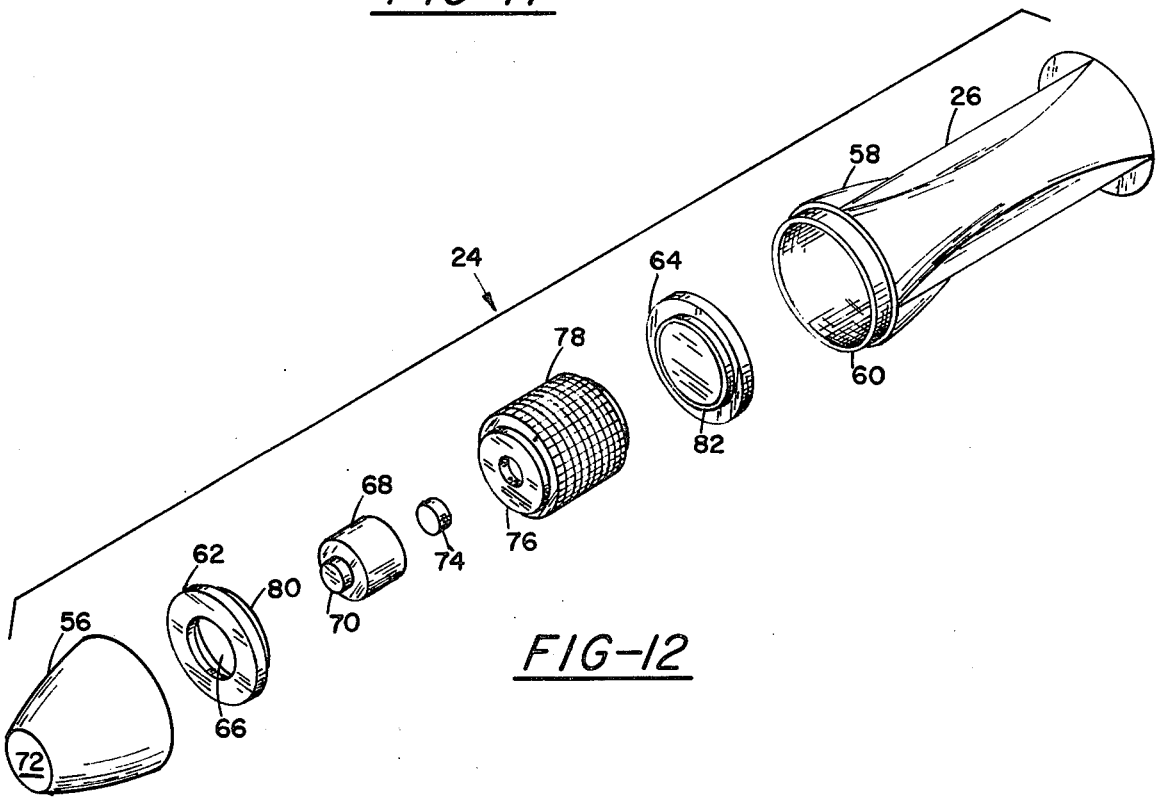
Figure 13:
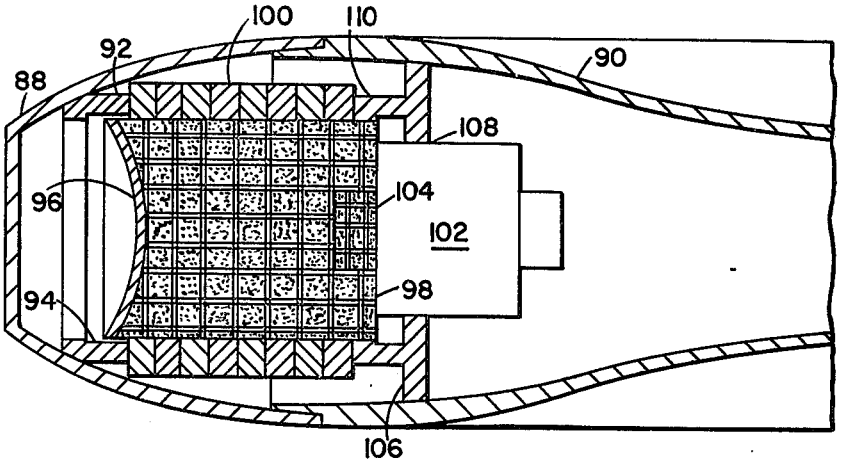
Figure 14:
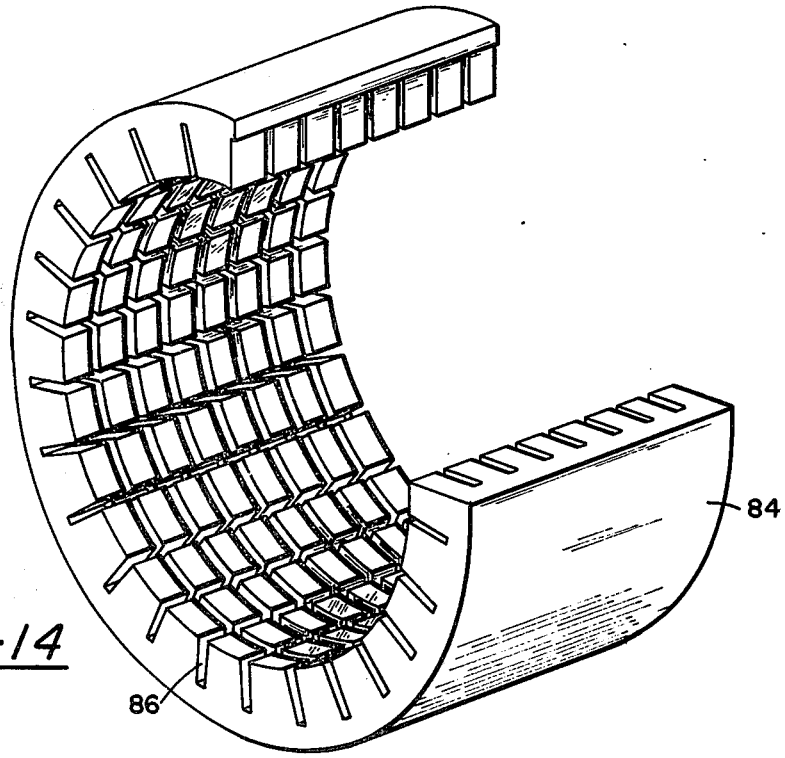

With the above and other objects in view, which will be apparent from the following detailed description to those skilled in the art, the invention consists in certain features of construction and combinations of parts to be hereinafter described with reference to the accompanying drawing:

FIG. 1 is a perspective view of the canister starting to separate from the missile, FIG. 2 is a schematic showing of the canister within the missile, FIG. 3 shows the canister immediately after ejection, FIG. 4 shows the canister with the fins rotated into locked position less than ½ second from the position shown in FIG. 3, FIG. 5 illustrates the fins acting as drag brakes, FIG. 6 shows the fins in canted position, FIG. 7 shows a top fragmentary view of the canister with one method of operating the fins, FIG. 8 is an enlarged detail of FIG. 7, FIG. 9 illustrates the canister as having burst and the sub-missiles being dispersed therefrom, FIG. 10 is a perspective view of a bomblet with a canted fin, FIG. 11 is a vertical sectional view of one bomblet utilized in the invention, FIG. 12 is an exploded view of the bomblet of FIG. 11, FIG. 13 is a vertical sectional view of another bomblet utilized in the invention, and FIG. 14 is an illustration of pre-cut fragments of selected size to be utilized in a bomblet.

The invention will be described in its relation to providing a warhead for a missile.

As is readily apparent from an examination of the figures, the canister 20 is retained in the missile 22 and in turn, retains the anti-materiel bombs or sub-missiles 24 therein (see FIG. 10). In the determination of the best warhead design possible, it was necessary to first provide an effective anti-materiel bomb or sub-missile. The external configuration of a proposed type of chemical bomb was utilized, with the design modified particularly so that the fins 26 thereof are canted in order to obtain the desired spin revolution. With the selection of the desired sub-missile, it was necessary to provide a suitable holder therefor. The canister 20 was selected and is especially suitable since it provides not only structural support but protection against high temperature as well. Now, in order to release the sub-missiles 24 from the missile 22 and to disperse them over the desired target area it is necessary to provide some suitable, failure-proof method. The use of the canister 20 provided the solution and by its structure, also enabled it to take advantage of aerodynamic forces in order to retard and rotate it. This action then disperses the sub-missiles by the resultant centrifugal force. It is, of course, necessary to slow the canister to a reasonable velocity to keep the centrifugal force within bounds for structural requirements while maintaining a ratio of tangential to forward velocity in order to obtain a dispersion as desired. The unique canister provides all these necessary limitations.

Referring to FIGS. 1 thru 9 specifically, the canister 20 comprises a cylindrical body 28 having a hollow interior 30 within which the payload of bomblets or sub-missiles 24 are retained in compartments by means of the "wafer-like" discs 32. A probe member 34 extends from the canister 20 and contains the pressure pick-up to actuate a barometric switch in the safety and arming device which is located within the canister, and adapted to open at a specified altitude. The fuze utilized to operate the canister is retained within the probe member 34. None of these elements are illustrated since they are conventional in construction and to which no inventive claim is made.

The cylindrical body 28 must constrain the sub-missiles. The centrifugal force on the wall is a function of the angular velocity. Treating the canister as if it were filled with a fluid, then $$df = dm - rw^2$$

and the hoop stress is $$s = f/2t,$$

or $$t = f/2s$$

The following table indicates the required wall thickness has a function of radial velocity, for two stress levels: 75,000 psi and 30,000 psi.

| Vr-fps | W-rad/sec | F-lbs/in | t75 | t30 |
|---|---|---|---|---|
| 100 | 53.4 | 5,737 | .034 | .096 |
| 150 | 80 | 13,000 | .087 | .22 |
| 200 | 106.8 | 22,750 | .153 | .38 |

Targets of 500 to 5,000 feet radius are within the range considered in this example in order to establish the relationship between target radius, burst height, and canister velocity, the following pattern sizes are considered. For a canister terminal velocity of 400 fps the required opening height will be a function of pattern radius, R and radial velocity, Vr, as follows:

| Vr-Fps | R-ft | H-ft | R-ft | H-ft |
|---|---|---|---|---|
| 100 | 500 | 2,000 | 5,000 | 20,000 |
| 150 | 500 | 1,332 | 5,000 | 13,320 |
| 200 | 500 | 1,000 | 5,000 | 10,000 |

The desired opening height of the canister then will range from 1,000 to 20,000 feet depending on the choice of radial velocity and pattern radius. The barometric fuze in the canister (not shown) should be operative in this range with the canister at its terminal velocity.

The rate of spin and control of the canister to slow its movement whereby the sub-missiles may be ejected are provided in the fins 36 secured at the upper extremity of the canister 20 in a manner to permit subsequent controlled rotation. When the canister 20 has just been ejected from the missile, the fins are in the position shown in FIG. 3. Almost simultaneously with the ejection, an explosive cartridge 111 becomes operative and the fins are rotated about the vertical axis to a 90° position from that shown in FIG. 3 and as illustrated in FIG. 4 and is locked into that position. In order to actuate the fins to the drag brake position of FIG. 5 and finally to the canted position shown in FIG. 6, a structure to achieve this result is illustrated schematically in FIGS. 7 and 8. An arm 38 is secured at 40 to each fin member 36 and is pivotally secured at 42 by means of a pivot pin or the like to a lever arm 44. The lever arm 44 is contained within the hollow tube 46. Each hollow tube 46 is rotatably mounted on body 28 and provided with the cylindrical gear means 48 which is in engagement with the flat circular gear 50. An electric motor 52 actuates a drive gear 54 which is in engagement with the flat gear member 50. Thus, upon receiving an electrical signal from a battery (not shown), the latter being programmed by a timer, the explosive cartridge 111 is actuated to unfold the fins to the position shown in FIG. 4. When next command emanates (as by the closure of a switch, not shown) from the timer, the electric motor 52 drives the flat circular gear 50, which in turn rotates the tubular members 46, to which the fin members 36 are attached, by means of the driven gear member 48. This action causes the fins 36 to assume the horizontal position illustrated in FIG. 5 and to thereby achieve a braking effect. The timer utilized delays a suitable interval, thereby permitting the canister 20 to slow its fall, and then actuates the motor 52 to rotate the fins 36 again to the position illustrated in FIG. 6. The barometric fuze located in the probe 34 senses the proper altitude, and initiates a skin cutting charge (not shown). This releases the sub-missiles 24, as is illustrated in FIG. 9, and as will be later described in greater detail.

The sub-missiles utilized are illustrated in detail in FIGS. 10–14. The submissile 24 is shaped as is illustrated in FIG. 10 and is provided with canted fins to permit the submissile or bomblet to rotate at 2,500 rpm spin. Variations of this shape which reduce drag or otherwise improve performance could be used. Referring to FIGS. 11 and 12, the bomblet 24 is provided with the forward body member 56 and the aft body member 58. It should be noted that the aft body member 58 is provided with a reduced diameter flange 60 whereby the forward body member 56 is capable of being press fit thereon in overlapping position. These elements may be bonded together by any suitable adhesive to prevent motion within the body and the material utilized may be of a molded plastic or metallic material such as aluminum or magnesium, if desired.

A forward retainer member 62 and a rearward retainer member 64 are disc-like in construction and are designed to retain the explosive assembly therebetween. Thus, as is illustrated in FIG. 11, the forward retainer 62 is designed to seat against the inner converging wall 56 of the forward body member while the rearward retainer member 64 seats against the aft body member 58. The forward retainer member is provided with an axial opening 66. The fuze 68 extends through the axial opening 66 and is provided with an extension pin 70, adapted to seat against the front wall 72 of the bomblet 26. This stops the forward motion of the fuze 68 when it has been inserted into position. The booster 74 and the charge 76, comprising the explosive elements, are axially held in position with the fragments 78 retained in axial position by means of the flange members 80 and 82 of the forward retainer member 62 and the rearward retainer member 64, respectively.

The cylindrical explosive charge is capable of projecting fragments from less than 1 grain in size to approximately 30 grain fragments at velocities readily calculable by standard techniques. The fragment size may be provided in any manner desired, and an example of such type is found in FIG. 14. This form is the well known "waffle iron" pattern, consisting of a nodular cast iron or steel, metal ring 84 with the transverse grooves 86 on the inside surface. The grooves 86 score the metal ring 84 and when exploded provide a high degree of fragment control, with resultant devastating effects on exposed personnel. Of course, other forms of fragmentation may be provided. For example, pre-cut pieces of metal may be assembled on a paper sleeve, and then painted with a polyester or other resin or die cast metal to fill in all voids and to provide strength. The, the sections 56 and 58 of the bomblet provide the necessary aerodynamic shape and structural support for the components therein. These latter are held in place by retainer members 62 and 64 with the fuze 68 initiated by ground impact. This causes the booster 74 to detonate and to initiate the main explosive charge 76, thereby propelling the fragments 78 in radial directions.

A further form of this design is illustrated in FIG. 13. Additional antimateriel and anti-personnel capability is provided, wherein penetration of light armor is obtained by the incorporation of a shaped charge liner. The bomblet shell is herein also provided with forward and aft body members 88 and 90 respectively. The forward retainer 92 is provided with a reduced conical forward section 94 against which the shaped charge liner 96 is adapted to seat. The explosive charge 98 is surrounded by the fragments 100. However, in this construction the fuze 102 and the booster 104 are placed in the rear end of the explosive charge 98. The rear retainer 106 is fit into the bomblet and is also axially bored at 108 to receive therethrough the fuze member 102. The flange 110 helps seat the fragment 100 in aligned position. The fuze of this form is initiated by inertia rather than direct impact.

In the design of the unique warhead of the invention, the Redstone missile was utilized to carry out the inventive concept. The primary propulsive thrust of the missile is obtained from a single booster motor. The final adjustment of missile velocity is obtained with low thrust motor units which operate after cut off of the booster. Following completion of the booster phase, the booster section is separated from the rest of the missile. The two sections follow separate trajectories to impact. The cargo section of the missile carries the warhead of the invention, and the range varies from 75 to 175 miles and the temperature throughout the cargo section is nearly constant at about 50° C for the first 315 seconds of flight; then rises to about 250° C at about 350 seconds. In the device shown, targets of from 500 to 5,000 feet radius were considered. The desired opening height of the canister ranges from 1,000 feet to 20,000 feet depending upon the choice of radial velocity and pattern radius. The canister is normally supported fore and aft with four "tracks" running down the entire length which engage "rails" secured to the missile structure. Circumferential cutting charges sever the missile skin and the aft canister support simultaneously. A small propellant charge in the nose cone of the missile separates the section forward and the canister is then expelled along the rails by a small rocket motor or propellant charge located at the base of the canister. This structure is not shown in detail since it is not considered part of the invention and is not required for an understanding thereof. Immediately after the canister has been ejected the fins 36 are rotated to the position shown in FIG. 4 by the small explosive cartridge 111. The drag brake effect follows, as is illustrated in FIG. 5 and rotation is obtained to the canted position shown in FIG. 6. The barometric switch located in the probe 34 then operates to cause the canister wall to break. It should be noted that the spin rate of the canister at this point is approximately 150 feet per second to tangential velocity. With the walls of the canister opening, the bomblets 26 are dispersed centrifugally as is illustrated in FIG. 9, to effect damage to material or to personnel within the area covered. When the fragments obtained by the bursting of elements 78 or 100 are of 1 grain size or greater, the effects on personnel either in the standing position or in the prone position are lethal.

While the description of the above system is but one form of the invention others are possible. For example, the canister could be ejected from the nose of the payload compartment, or it may be ejected from a rearward position. Possibly by this method there might be less interference between the canister and the missile after separation. Also, a shaped charge liner in the forward end is usable. Another type of sub-missile design would provide the basic explosive system with folding fins. In this case, the plane of the fins should be skewed so as to provide lift in a direction parallel to the sub-missile axis, similar to the lift generated by helicopter rotors. Dispersion would then be obtained through drift. In this manner, the sub-missiles would be self-dispersing. Another possibility would provide an air bursting sub-missile. Other types of fuzes might include ultrasonic Doppler fuzes; or a system which, through a propellant charge at the forward end would, on impact, throw the explosive system back into the air with a pyrotechnic delay to initiate it.

It should be obvious to those skilled in the art that the description above relates to simply one or more forms of the inventive concept and is not limiting except as in the appended claims.

We claim:

1. An anti-material missile comprising a tubular housing member, anti-material sub-missiles retained in said housing member and adapted to be dispersed by centrifugal force when said housing member is rotated, a plurality of control fins for slowing and rotating said housing member, and means for mounting said fins on said housing member and for moving said fins into operative positions, comprising a plurality of tubular mounting means mounted on said housing member for rotation about a first axis normal to the longitudinal axis of said member, a plurality of arm means each attached to one of said fins and mounted on one of said tubular means for pivotal movement about a second axis normal to said first axis, means for pivoting said arm means to orient said fins in radial planes parallel to said longitudinal axis, and means for independently rotating said tubular means to re-orient said fins in radial planes canted with respect to said longitudinal axis, to cause rotation of said missile during flight 2. The combination of claim 1, wherein said means for rotating said tubular means comprises a cylindrical gear on each of said tubular means, a common flat circular gear engaging all of said cylindrical gears, and an electric motor geared to said common gear.

3. The combination of claim 1 wherein said housing includes spacing means to provide separate compartments, said submissiles being retained in said compartments, and canted fins on said submissiles whereby they will rotate at predetermined revolutions per minute to provide an additional signature for submissile fuzing.

4. The combination of claim 1, wherein each of said sub-missiles contains a mass of connected metal fragments of not more than 30 grains in weight surrounding an explosive charge for dispersing said fragments.

5. The combination of claim 1, wherein said means for pivoting said arm means comprises an explosive cartridge connected to each of said arm means.

6. The combination of claim 1, wherein said housing member includes means for rupturing said member to release said submissiles therefrom at a predetermined time during flight.

* * * * *